US006267059B1

(12) United States Patent
Brandt

(10) Patent No.: US 6,267,059 B1
(45) Date of Patent: Jul. 31, 2001

(54) LOW CLEARANCE TRAIN POSITIONER

(75) Inventor: Calvin J. Brandt, Delano, MN (US)

(73) Assignee: Motion Controls, Inc., Delano, MN (US)

( * ) Notice: Subject to any disclaimer, the term of this patent is extended or adjusted under 35 U.S.C. 154(b) by 0 days.

(21) Appl. No.: 09/546,984

(22) Filed: Apr. 11, 2000

(51) Int. Cl.[7] ..... B65G 67/00

(52) U.S. Cl. ..... 104/162; 104/176; 104/166; 104/172.5

(58) Field of Search ..... 104/162, 176, 104/166, 172.5, 88.01; 414/359

(56) References Cited

U.S. PATENT DOCUMENTS

| | | | | |
|---|---|---|---|---|
| 3,695,185 | * | 10/1972 | Rose | 104/176 |
| 4,006,691 | * | 2/1977 | Kacir et al. | 104/176 |
| 4,038,927 | * | 8/1977 | Evans | 104/162 |
| 4,354,792 | * | 10/1982 | Cornish | 414/359 |
| 4,633,784 | * | 1/1987 | Hoehn et al. | 104/162 |
| 5,709,153 | | 1/1998 | Brandt . | |

FOREIGN PATENT DOCUMENTS

| | | | | |
|---|---|---|---|---|
| 2101244-A | * | 1/1983 | (GB) | B61K/7/20 |
| 2101244A | * | 1/1983 | (GB) | B61K/7/20 |
| 0998193 | * | 2/1983 | (SU) | 104/176 |

* cited by examiner

*Primary Examiner*—S. Joseph Morano
*Assistant Examiner*—Frantz F. Jules
(74) *Attorney, Agent, or Firm*—Nikolai, Mersereau & Dietz, P.A.

(57) ABSTRACT

A train positioning system for moving railroad cars by engaging bogey frames from one side includes a dog carriage guideway spaced from and parallel to a railroad track, a dog carriage mounted to operate along the guideway, a first dog pivotally attached to the dog carriage to pivot in a generally horizontal plane between a retracted position and an extended position. The first dog is positioned to engage a bogey frame in a first direction and be deflected by the bogey frame in a second direction in the extended position. A second dog may be mounted in opposed spaced relation to the first dog also to pivot in a generally horizontal plane between a retracted and an extended position. The second dog is configured to engage a bogey frame in the second direction and be deflected by the bogey frame in the first direction. A system is provided for reversibly operating the dog carriage along the guideway.

13 Claims, 4 Drawing Sheets

LOW CLEARANCE TRAIN POSITIONER

BACKGROUND OF THE INVENTION

I. Field of the Invention

The present invention relates generally to train handling equipment and particularly to systems for indexing a coupled string or trip of cars through a work station, one or more cars at a time during loading or unloading operations. More specifically, the present invention is directed to such a system that is useful in addressing situations of high pit grading where ground clearance is minimal and a unit of compact or low profile is required. The system employs horizontally extending cantilevered car engaging and propelling members to contact the lower portion of car bogey wheel frames.

II. Related Art

Trains, many containing 100 or more cars of identical or a variety of sizes, have long been acknowledged as desirable and efficient carriers of bulk raw materials such as coal, iron ore, limestone, various finely divided dry bulk agricultural products including grains, etc., and liquid or dry chemicals. These cars are typically filled from above and may be emptied using a rotary car dumper in the case of coal or iron ore or, particularly in the case of agricultural products, bottom emptied into stationary freight handling equipment such as chutes, conveyor handlers or the like. The cars may be provided with a number of spaced bottom discharging hopper bins or chutes accessing the main storage volume of the car enclosed by sliding discharge gates. These are designed to be precisely positioned over dedicated recessed receiving facilities situated at fixed stations such as grain or coal bins and conveyors positioned beneath the railroad track. Liquid bulk cargo is typically unloaded by connecting outlets to large hoses with associated pumping equipment and opening bottom drain valves. The cargo then being pumped into tanks or tank trucks located near the tracks.

In the discharge operation, a connected train engine roughly positions one end of a string of cars to be unloaded close to the unloading facility. Because train engines are not well suited for indexing or precisely positioning individual cars or even sets of cars along the track, let alone precisely over individual bins, train positioning devices known as railroad car progressors or indexers have been built and operated at fixed stations. Railroad car indexers of the class of interest include at least one car engaging and propelling member or "dog" for engaging at least one railroad car in a string or trip of cars and moving the string a given distance along the railroad track. The engaging members often situated and operated along an auxiliary indexer track or guideway juxtaposed in parallel relation to the railroad track in the fixed receiving facility. Fluid operated actuators such as hydraulic cylinders or chains and sprockets driven by hydraulic or electric motors supply power for moving the dog and pulling the railroad cars. U.S. Pat. Nos. 4,006,691, issued to Kacir et al, and 4,354,792, issued to Cornish, show train positioners that approach the train from alongside the track and including an engaging member arm which engages a car coupler from above.

Other types of indexing or positioning devices utilize dogs in the form of heavy vertically pivoting car-engaging arm members which are designed to engage and advance either the railway bogey wheel truck frame or an axle. The dogs are smaller than car coupler engaging arms and are carried by dog carriages which ride on a dog carriage indexer track situated either between the rails of the railroad track to engage the axle or next to the railroad track to engage the bogey truck frame. Bogey frame-engaging dog systems may be further divided into two types. One type includes "low dogs" which are dogs that engage the lower portion of the truck frame below the axle; and the other employs "high dogs" which engage the frame at or above the height of the axles. One such system using high dogs is described in U.S. Pat. No. 5,709,153 to Brandt, the inventor of the present invention, is assigned to the same assignee as the present invention.

Most of these indexing systems require an amount of space below the track level between or alongside the track to accommodate elements of the systems required to operate the vertically pivoting dogs which pop up to engage the bogey frames or axles of cars and are dropped for storage. Unfortunately, many facilities for conducting unloading operations have been constructed with very little vertical room for the installation of auxiliary equipment between or alongside of the rails due to high pit gradings and existing slab access pit covers or the like. This leaves very little vertical space to accommodate train indexing equipment including operating systems and dogs alike. This precludes the installation of most types of conventional vertically operating high or low dog systems. Accordingly, there exists a need for a vertically compact train indexing system that can be effectively installed and operated in low clearance environments.

Accordingly, it is primary object of the present invention to provide a low clearance train positioning system that can be used in situations of zero track clearance.

It is a further object of the present invention to provide a low clearance train positioning system that uses horizontally operating dogs to engage the bogey frame of a car from the side.

A still further object of the present invention is to provide a low clearance train positioning system that is a reversing system utilizing spaced opposed dogs.

Another object of the present invention is to provide a low clearance train positioning system that includes a system for retracting and locking down the dogs.

Yet another object of the present invention is to provide a low clearance train positioning system utilizing horizontally operating low dogs which pivot in a low horizontal plane to engage the bogey frame of a car from the side.

Still another object of the present invention is to provide such a low clearance train positioning system utilizing horizontally pivoting arm-like low dogs which includes a system for stabilizing empty cars.

Yet still another object of the present invention is to provide a low clearance train positioning system capable of being installed without disturbing existing track-high, track side concrete pads.

Other objects and advantages associated with the present invention will reveal themselves or become apparent to those skilled in the art upon familiarization with the specification, drawings and claims contained herein.

SUMMARY OF THE INVENTION

The present invention provides a low clearance train positioning system that can be installed at track level alongside an existing railroad track without disturbing the existing track-high, track side concrete pads. The system is installed and operates alongside and parallels the track using carriage-mounted, horizontally pivoting, bogey wheel frame-engaging low dogs to engage and advance successive car bogey frames. The dog carriage is of a low profile, preferably not protruding above the level of the pivot mounting shafts for the dogs and the positioner may be chain driven using a hydraulic motor or the like. The dogs are constructed to pivot or be locked down in the seeking mode (retracting direction) and pull or push the bogey wheel frame in the opposite direction during positioning. A dog lock-down system is also provided and a car hold-down device attached to the dog carriage can be used to prevent derailing of empty cars by the low dogs.

The train positioning or progressing system may be operable in a single direction or may be made reversing using a pair of spaced opposed dogs designed to collapse or pivot inward toward each other, each configured to deliver a power or push against a bogey frame in one direction and lock down or seek or detect in the other in the extended state.

Each dog is operable between an outwardly extended position, generally perpendicular to the direction of the track and a retracted or lock-down position generally flat against the dog carriage parallel to the track. Each dog is a laterally pivoted pusher arm which is spring biased to remain in an extended position unless deflected by a bogey carriage or forced down to lock by a lock-down roller and cam system or other lock-down system, possibly using a chain and sprocket, which overcomes the spring bias. Each dog then is designed to pivot in one direction and engage and pull in the other.

Since each dog is spring biased in the extended position, the dog lock-down system must overcome the force of the spring system. One alternate system beside the roller and cam setup system includes a chain which is tensioned between a fixed end and a moving end operating over dog lock-down sprockets attached to end dog so that when the moving end is advanced by an attached lock-down hydraulic cylinder, the chain operates to provide sufficient force to overcome the spring load and positively pull the sprockets and down the dogs. The lock-down system may encompass a single dog or both dogs of a dual dog reversing system.

The dog carriage of the main positioning system of the present invention is slidably engaged on a dog carriage indexer track or guideway situated alongside the railroad track. The dog carriage is connected to a chain which meshes with a drive sprocket at one end of the indexer track and an idler pulley or sprocket at the other end of the indexer track or guideway. The drive sprocket can be offset from the guideway to be somewhat out of the way and is generally powered by a prime mover, such as a hydraulic or electric motor which is controlled to move the dog carriage in either direction along the indexer track. Of course, the dog carriage may be moved by other means, including fluid-operated actuators such as hydraulic cylinders or telescoping hydraulic cylinders, etc., if desired.

In operation, a dog carriage is moved along the indexer track to engage a railway car in a trip of railway cars which was previously rolled into the fixed station. To index the railway cars in a single dog system, the dog carriage is generally moved with the dog locked down, or in the case of a reversing progressor system, with both dogs locked down, the carriage being moved in the direction opposite of that in which it is desired to move the cars. After the carriage has bi-passed the bogey frame in a direction with the dog locked down, the dog will re-extend enabling the dog carriage direction of travel to be reversed and the car pulled in the opposite direction utilizing the extended dog. In this manner, a car or trip of cars can be pulled as far as the end of the dog indexer track or guideway. A can-operated lock-down roller system may be provided to cause a single dog to be automatically deflected down at the end of a stroke.

With respect to the detection of the presence of wheels and/or bogey frames on the cars of interest, of course, any compatible system may be employed. This includes proximity detection devices, optical beam systems and using the back deflection of the dogs themselves. Such devices are well known to those skilled in the art, examples of which are shown in co-pending U.S. application Ser. No. 09/069,506, filed Apr. 29, 1998, to Calvin Brandt, the inventor in the present application. A further independent dog operating system is shown in co-pending application Ser. No. 09/546,956, filed of even date, and assigned to the same assignee as the present application. These documents are deemed incorporated herein by reference for any purpose.

BRIEF DESCRIPTION OF THE DRAWINGS

In the drawings wherein like numerals designate like parts throughout the same.

DETAILED DESCRIPTION

In accordance with aspects of the invention, it should be remembered that the detailed description contained herein is intended by way of example and not intended by way of limitation with respect to any aspect of the invention. In accordance with one aspect of the invention, an important use of the low clearance train positioner system of the invention is in retrofitting present rail car addressing facilities which present inherent limitations with respect to the installation of a new positioner or indexing system. This is especially true with respect to low clearance devices which must be installed along tracks with predisposed dedicated material receiving facilities which include existing track side pit grading levels and concrete pads covering present access pits. The tops of these may be at track level leaving very little space for systems designed to operate from the side against bogey wheel carriage frames. The system of the present invention enables the installation of a track side bogey frame pulling system having an overall carriage and dog height well under one foot.

Figure 1:
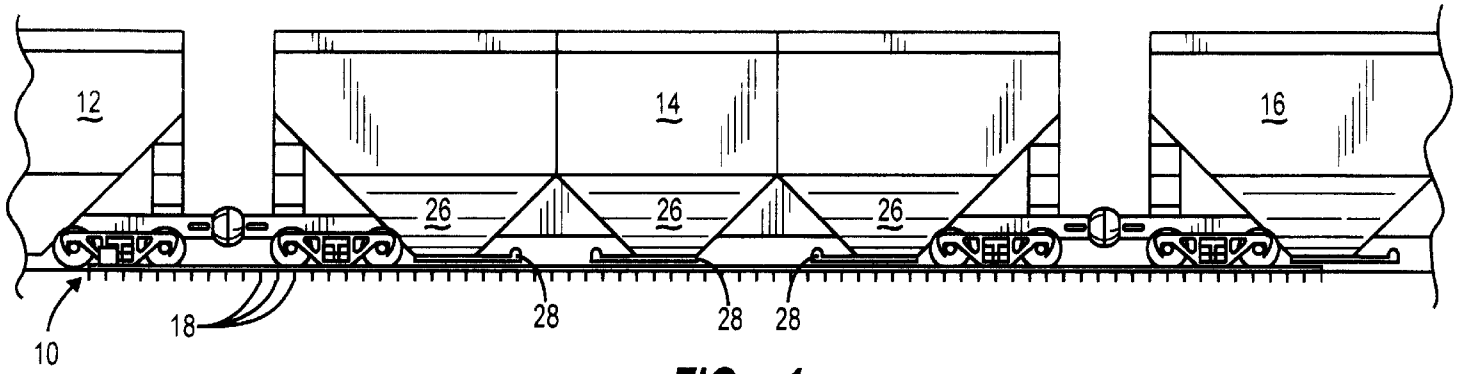
FIG. 1 is a side elevational view depicting a general layout of a cantilever dog indexer system in a accordance with the invention, including a fragment of a trip of cars.
Figure 2:
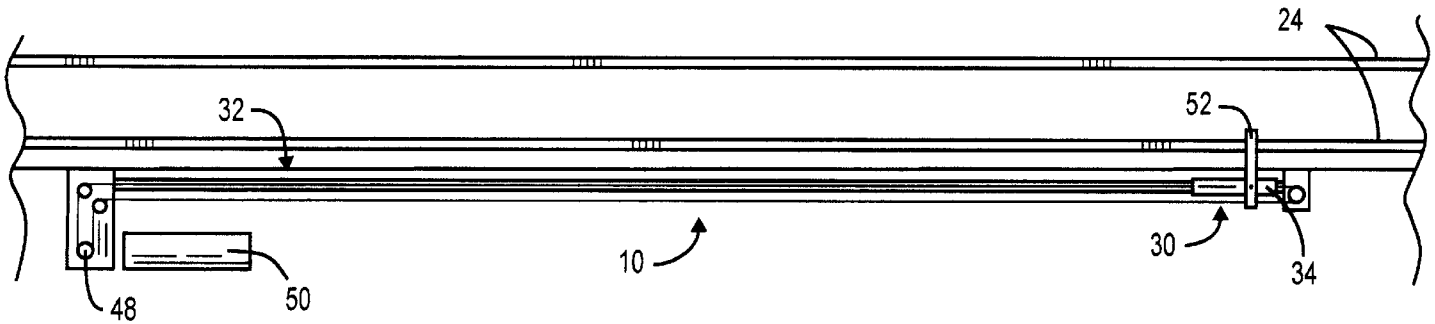
FIG. 2 is a top view of the general layout of FIG. 1 with the cars removed.
Figure 3:
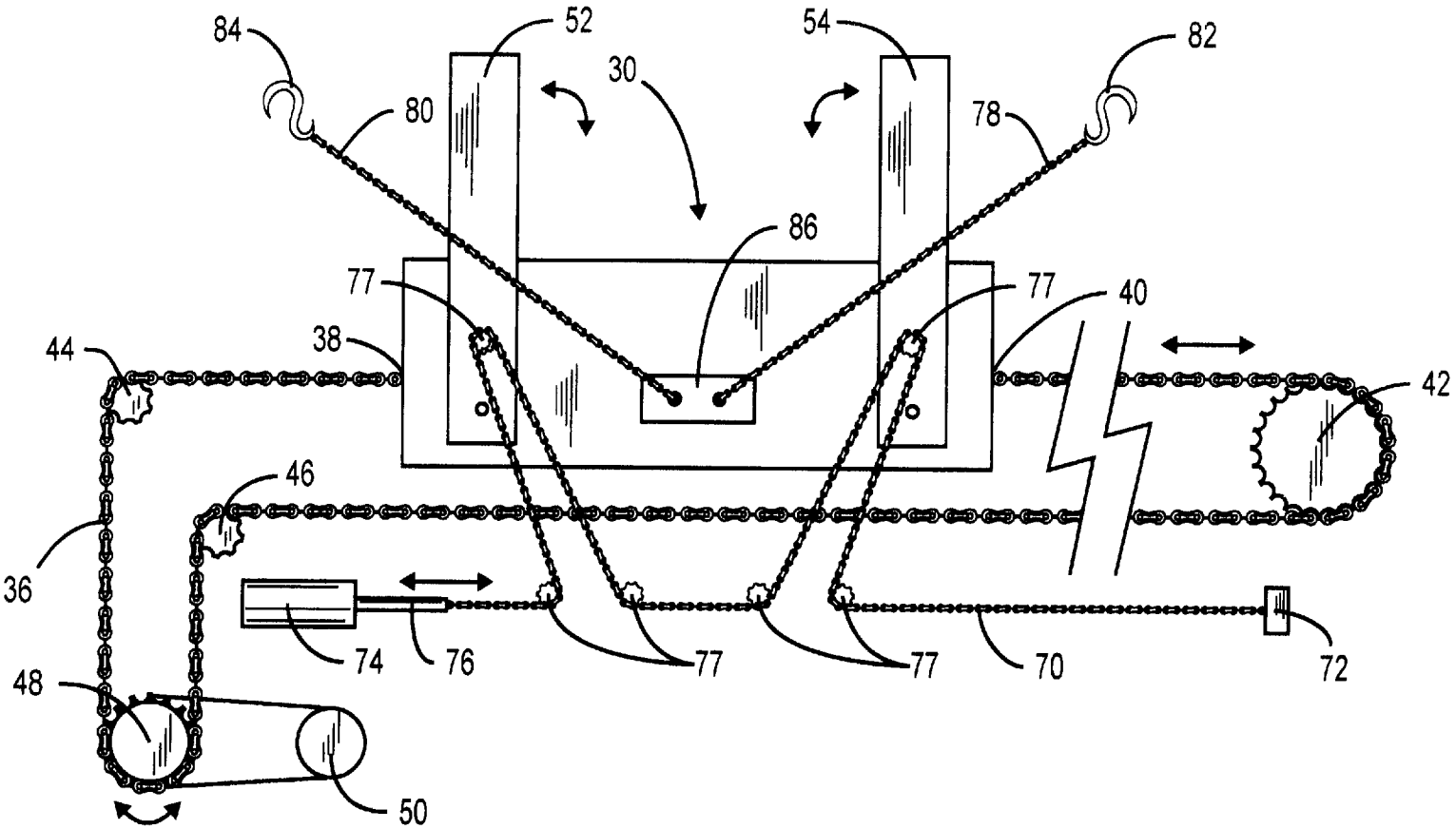
FIG. 3 is a schematic drawing not to scale illustrating elements of a configuration of a two-dog system.
Figure 4:
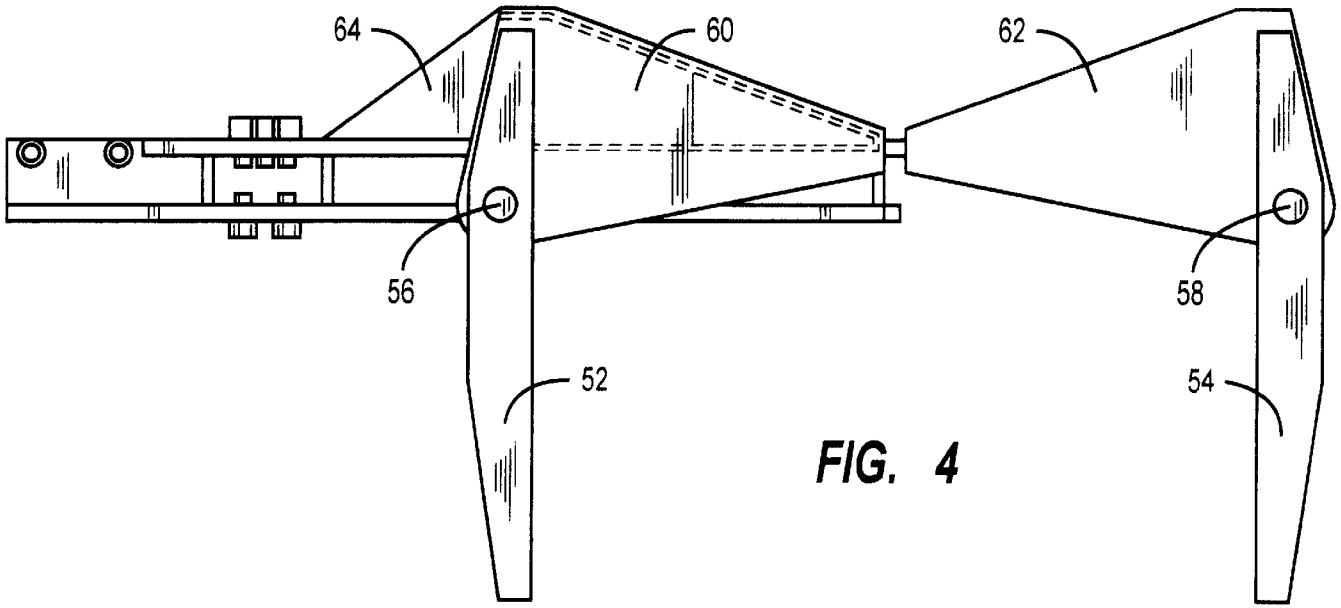
FIG. 4 is a top view of the dog carriage system constructed in accordance with the invention showing also provision for a second, opposed dog.
Figure 5:
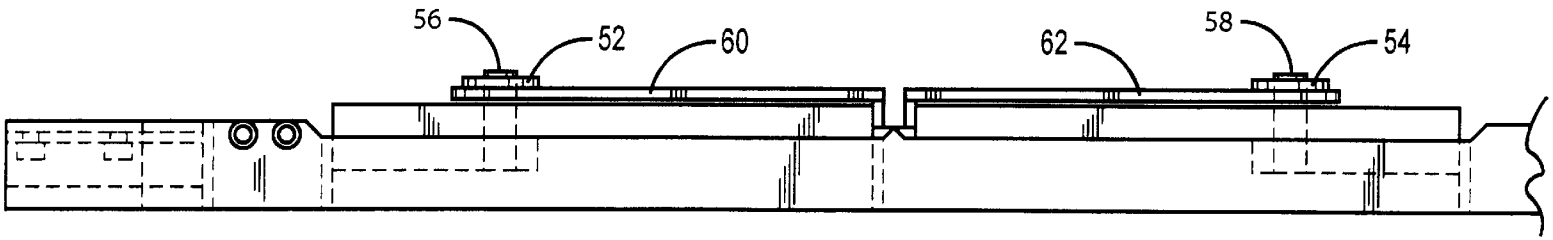
FIG. 5 is a track side view of the dog carriage system of FIG. 4.
Figure 6:
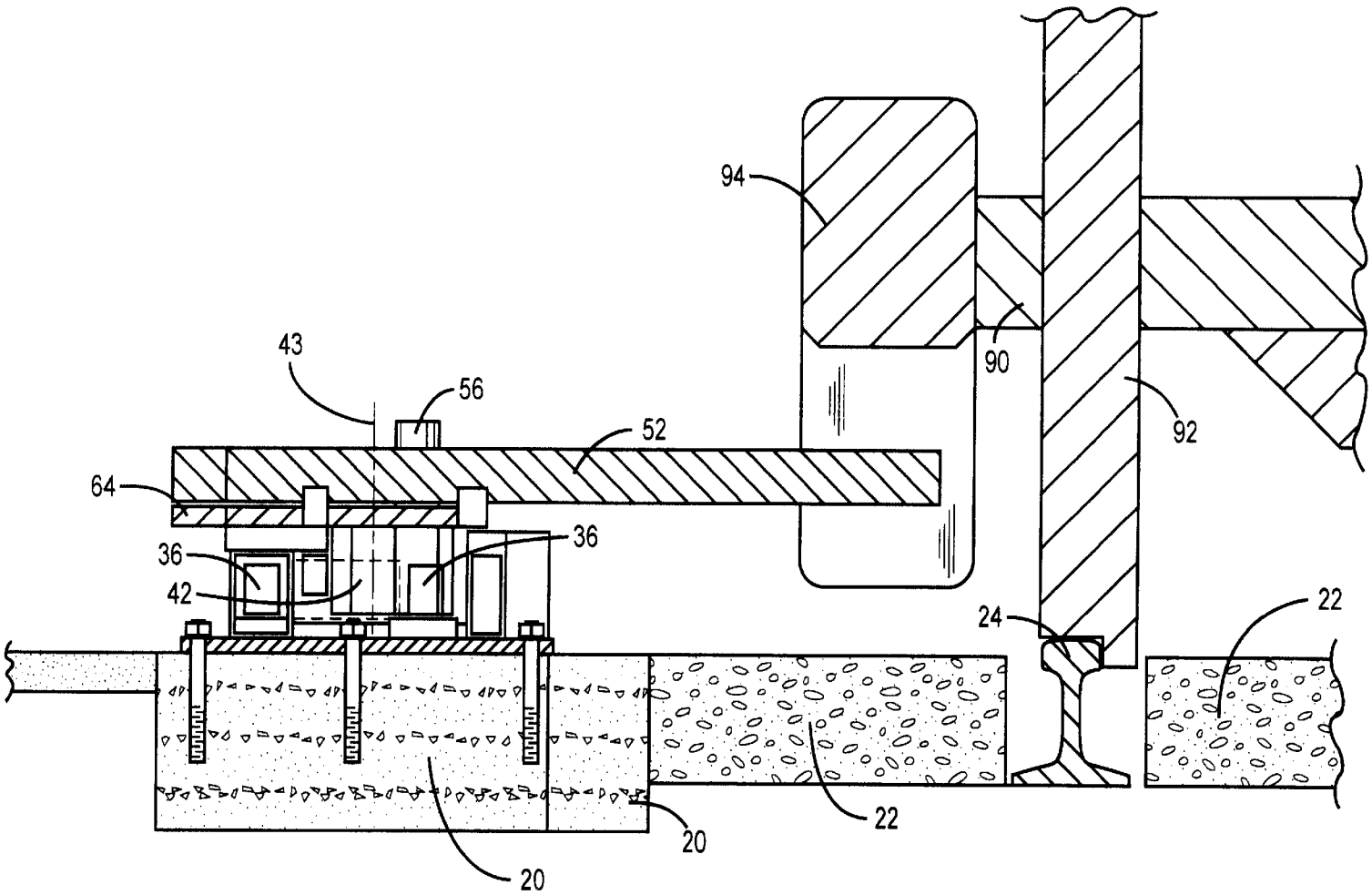
FIG. 6 is a greatly enlarged end view of the dog carriage system of FIGS. 4 and 5.

One embodiment of the low clearance train positioner of the present invention is depicted generally at 10 in FIGS. 1–3. In FIG. 1, a partial trip of coupled cars 12, 14 and 16 is shown substantially centered with respect to an embodiment of the train positioning system of the invention. FIG. 1 shows a series of spaced adhesive anchors 18 utilized to anchor the system of the invention into a concrete pad 20 shown in FIG. 6. FIG. 6 also depicts the pit grading 22, the top of which is almost at the top of the level of the rail 24. Each of the cars includes a plurality of bottom discharge bins 26 enclosed by sliding gate mechanisms 28 configured to be operated when the car is properly positioned over the receiving pit. The indexer of the invention generally includes a dog carriage 30 operable along an elongated auxiliary indexer track or guideway 32 juxtaposed in parallel relation to the railroad track having rails 24 at the fixed receiving facility. The drive mechanism includes a reversible chain 36 attached to the ends of the dog carriage at 38 and 40 and proceeding around a horizontal end idler sprocket 42 and idler sprockets 44 and 46 and offset reversible drive sprocket 48 (FIGS. 2 and 3) may be used in conjunction with a hydraulic power unit including a motor at 50 or other rotating prime mover such as an electric motor.

The dog carriage 30 is further illustrated as carrying a pair of opposed horizontally-operating, cantilevered train-pulling dogs 52 and 54, shown in the fully extended position in FIGS. 2–5. FIG. 2 depicts a single dog system including only dog 52 on the carriage 30. A lock-down roller is shown at 34. Each of the dogs 52, 54 is mounted to pivot on shafts or pins 56 and 58, respectively. The pivot shafts 56 and 58 also respectively carry top dog plates 60 and 62. Bottom dog plates as at 64 are also provided. FIG. 6 further depicts the axle 90 with wheel 92 and a bogey frame at 94 as shown being contacted with the cantilevered dog member 52.

The schematic illustration of the system in FIG. 3 further includes a chain 70 which operates between a fixed anchor 72 and a hydraulic cylinder 74 with piston 76 is designed to be retracted or collapsed to pull the chain 70 over idler sprocket 77 which include dog-mounted sprockets thereby dropping the dogs 52 and 54 by overcoming the spring bias holding them in the extended position. Because, as shown in the cross-section view of FIG. 5, the heavy gauge dog 52 engages the lower portion of the bogey frame 94, produces sufficient force to actually cause an empty car to raise up and derail. Additional anchor chains are provided at 78 and 80 which have respective hooks 82 and 84 and are anchored to the dog carriage at 86 can be caused to be attached to corresponding chain receiving members on the sides of railroad cars to prevent empty cars from riding up during advancement using the indexing system of the present invention.

It will be appreciated that the carriage carrying the dogs as illustrated can move in either direction and each dog is designed to pivot inward toward the other dog in one direction and to exert a pulling force in the other direction as illustrated. The lock-down system illustrated may encompass a single dog; or both dogs of a dual reversing system can be included, as illustrated in FIG. 3. Note that in FIG. 2 lock-down roller 34 is also illustrated which operates with a cam system (FIG. 6) to drop a single dog at the end of a return stroke. It will be appreciated that when the dogs are retracted or locked down, the pivoted dog is fully contained within the width of the corresponding dog carriage so that the system is totally clear of the bogey wheel truck frame.

Whereas the pivoting cantilevered dogs themselves may be utilized in the fashion of traditional low-dog systems to detect the presence of a bogey wheel truck frame by striking the frame during the return stroke and being deflected in springing back after the passage of the bogey wheel truck frame, it is preferred that other well-developed optical or proximity sensing systems be utilized to control the dogs in relation to the location of the sensed bogey wheel truck frames. These include cam-operated systems as shown in the above-referenced co-pending application filed of even date.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A low-clearance, dual dog, reversing train positioning system for engaging and moving a railroad car or a trip of coupled cars by engaging bogey wheel truck frames from one side comprising:

(a) a dog carriage guideway spaced from and parallel to a railroad track;

(b) a dog carriage mounted to operate along said guideway;

(c) a first dog member pivotally attached to said dog carriage a vertical pivot for said first dog member pivoting in a generally horizontal plane between a first retracted position and a first extended position wherein said first dog member is positioned to engage a proximate bogey wheel truck frame in a first direction and be deflected by said bogey frame in a second direction in the extended position;

(d) a second dog member mounted pivotally attached to said dog carriage in opposed spaced relation to said first dog member by a vertical pivot for pivoting said second dog member in a generally horizontal plane between a retracted and an extended position wherein said second dog member is positioned to engage said bogey wheel truck frame in said second direction and be deflected by said bogey frame in said first direction in the extended position; and (e) reversing means for reversibly operating said dog carriage along the adjacent railroad track.

2. The train positioning system of claim 1 wherein no clearance below track level is required.

3. The train positioning system of claim 1 wherein the highest points of the system are pivot mounts for said first and said second dog members.

4. The train positioning system of claim 2 wherein the highest points of the system are pivot mounts for said first and said second dog members.

5. The train positioning system of claim 1 further comprising means for locking down at least one dog member.

6. The train positioning system of claim 1 further comprising a cam-operated lock down roller system for automatically deflecting the appropriate dog down at the end of a progressor stroke.

7. The train positioning system of claim 1 further comprising a device for detecting the presence of a bogey frame.

8. A low-clearance, single dog train positioning system for engaging and moving a railroad car or a trip of coupled cars by engaging bogey wheel truck frames from one side comprising:

(a) a dog carriage guideway spaced from and parallel to a railroad track;

(b) a dog carriage mounted to operate along said guideway;

(c) a dog member pivotally attached to said dog carriage by a vertical pivot for pivoting said dog member in a generally horizontal plane between a first retracted position and a' first extended position wherein said first dog member is positioned to engage a proximate bogey wheel truck frame in a first direction and be deflected by said bogey frame in a second direction in the extended position; and (d) reversing means for reversibly operating said dog carriage along the adjacent railroad track.

9. The train positioning system of claim 8 wherein no clearance below track level is required.

10. The train positioning system of claim 9 wherein the highest point thereof is a pivot mount for said dog.

11. The train positioning system of claim 8 wherein the highest point thereof is a pivot mount for said dog.

12. The train positioning system of claim 8 further comprising means for locking down said dog.

13. The train positioning system of claim 8 further comprising a device for detecting the presence of a bogey frame.

* * * * *

UNITED STATES PATENT AND TRADEMARK OFFICE

CERTIFICATE OF CORRECTION

PATENT NO. : 6,267,059 B1
DATED : July 31, 2001
INVENTOR(S) : Calvin J. Brandt

It is certified that error appears in the above-identified patent and that said Letters Patent is hereby corrected as shown below:

Column 6,
Line 16, after "for", insert -- pivoting -- and after "member", delete "pivoting"; and
Line 61, after "a", delete " ' "
Line 62, after "engage", delete "proximate".

Signed and Sealed this

Eleventh Day of June, 2002

*Attest:*

*Attesting Officer*

JAMES E. ROGAN
*Director of the United States Patent and Trademark Office*